US005881421A

United States Patent [19]

Ducharme

[11] Patent Number: 5,881,421

[45] Date of Patent: Mar. 16, 1999

[54] DENTURE CLEANING BRUSH

[76] Inventor: Jean Claude Ducharme, 1765 de la Concorde, Duvernay, Laval, Canada

[21] Appl. No.: 822,619

[22] Filed: Mar. 20, 1997

[51] Int. Cl.[6] ..... A46B 9/04; A46B 5/02

[52] U.S. Cl. ..... 15/106; 15/143.1; 15/159.1; 15/167.1

[58] Field of Search ..... 15/106, 143.1, 15/159.1, 167.1, DIG. 5

[56] References Cited

U.S. PATENT DOCUMENTS

| | | | |
|---|---|---|---|
| 1,048,740 | 12/1912 | Sarrazin | 15/167.1 |
| 2,190,277 | 2/1940 | Viragh | 15/167.1 |
| 2,236,034 | 3/1941 | Luce | 15/167.1 |
| 5,383,244 | 1/1995 | Ahrens | 15/167.1 |
| 5,465,449 | 11/1995 | Lewkowicz | 15/167.1 |

FOREIGN PATENT DOCUMENTS

| | | | |
|---|---|---|---|
| 117317 | 1/1927 | Switzerland | 15/167.1 |
| 0004549 | of 1909 | United Kingdom | 15/167.1 |

*Primary Examiner*—Randall E. Chin

*Attorney, Agent, or Firm*—Swabey Ogilvy Renault; Paul Marcoux

[57] ABSTRACT

A denture cleaning brush is comprised of an elongated handle having a flared end. The flared end has a bristle receiving front face which is disposed substantially transverse to the longitudinal axis of the handle. A plurality of bristles are secured in the front face with the bristles oriented in a matrix which co-extends with the longitudinal axis. The matrix extends from the flared end and along the longitudinal axis of the handle in a plane disposed at an angle between 0° to 20°. The handle is shaped for engagement between the finger tips of a user person, similarly to that of a writing instrument, whereby to provide unobstructive visual access to the bristle matrix when cleaning any facet of a denture.

6 Claims, 4 Drawing Sheets

DENTURE CLEANING BRUSH

BACKGROUND OF THE INVENTION

The present invention relates to a denture cleaning brush capable of providing unobstructive visual access of the bristle matrix when cleaning any facet of a denture.

Many types of tooth brushes, including denture brushes are known. A review of the prior art has revealed several patents and among which reference is made to U.S. Pat. No. 5,459,898. As can be seen from this patent the denture cleaning brush is constructed similarly to a conventional toothbrush where the bristles are disposed on a side face of an extremity of the handle. A disadvantage of such brushes is that they are not practical for cleaning dentures where it is necessary to locate the bristles in restricted areas of the denture palate. U.S. Pat. Nos. 488,884 and 5,465,449 also show different brush designs for cleaning dentures and in which bristles extend at an angle and in a transverse direction. Again, such brushes do not permit cleaning hard to reach areas of dentures, particularly when there are undercut cavities formed in the forward area of the palate in wich the gum of the wearer is locates. These transverse bristles also obstruct the field of vision which is necessary to clean dentures adequately and with maximum efficiency and minimum effort.

Most denture brushes utilized are of conventional design where the handle of the brush is held in the hand of the user where a maximum amount of pressure is applied to the brush head to provide pressure scrubbing action to effectively clean the denture or the natural teeth which are hidden from sight. In most cases, the handles are not ergonomically designed and obliges people of diminished strength to grip and hold the handle firmly to effect the brushing. This exerts strain in the hand of such handicapped person. Also old people suffering of arthritis, rheumatoid arthritis will find hard to precisely locate the finger engaging cavity and firmly hold the uncomfortable square slightly rounded comer angle handle as shown in U.S. Pat. 5,465,449.

U.S. Pat. 5,014,383 shows another design where a large brush is utilized to clean dentures. Although this may be adequate to clean the outer surface of the denture, they are impractical to clean the hard to reach cavities in the palate area of the denture. It is constructed as a scrubbing brush which again is provided with a handle which is held firmly inside the hand.

SUMMARY OF THE INVENTION

It is an object of the present invention to provide a denture cleaning brush which has an ergonomic designed handle and wherein the bristle matrix is disposed in the same axis as the longitudinal axis of the handle thereby permitting constant eye monitoring while scrubbing dentures and reducing the amount of time and effort necessary to clean such denture.

Another object of the present invention is to provide a denture cleaning brush which has an attractive appearance and wherein the handle is held between the finger tips of a user person similarly to that of a writing instrument, to achieve the unobstructed visual access to the bristle matrix while cleaning any facet of a denture.

Another feature of the present invention is to provide a denture cleaning brush wherein the bristle matrix is configured to clean hard to reach areas of a denture plate.

A further object is to provide a denture cleaning brush with a bristle matrix at opposed ends of the handle and wherein the bristle matrix is of different length and/or texture.

According to these objects the invention provides a denture cleaning brush which comprises an elongated rigid handle having a flared end. The flared end has a bristle receiving front face which is disposed substantially transverse to the longitudinal axis of the handle. A plurality of bristles are secured in the front face with the bristles oriented in a matrix which is extending coextensive with the longitudinal axis of the handle. The matrix extends from the flared end and along the longitudinal axis in a plane disposed at an angle between 0° and 20° and is shaped for engagement between finger tips of a user person, similarly to that of a writing instrument, whereby to provide an unobstructed visual access to the bristle matrix when cleaning any facet of a denture.

BRIEF DESCRIPTION OF DRAWINGS

The above objects, advantages and features of the novel denture cleaning brush of the present invention will become apparent upon review of the following detail specification in conjunction with the accompanying drawings in which.

DETAILED DESCRIPTION OF THE PREFERRED EMBODIMENTS

Figure 1:
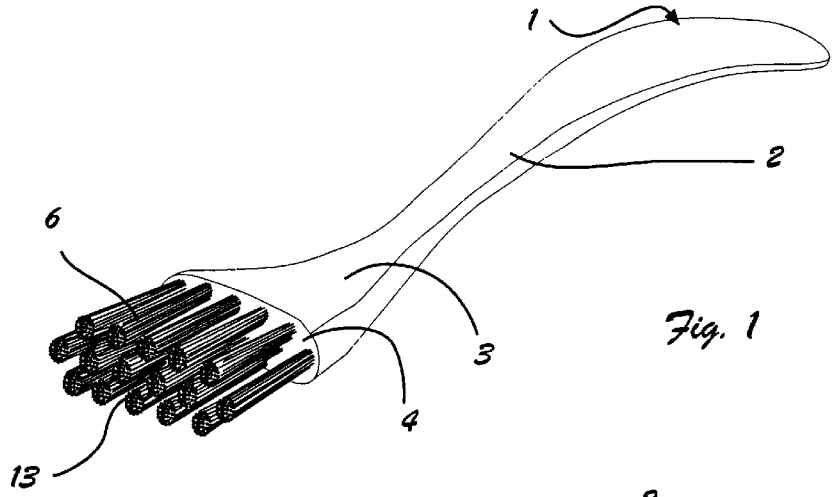
FIG. 1 is a perspective view of a preferred embodiment of the denture cleaning brush of the present invention.

Referring now to the drawings more particularly to FIGS. 1 to 4 there is shown my denture cleaning brush generally identified by reference numeral 1. The brush consists of a elongated handle 2 having a flared end 3 formed integrally therewith.

Figure 3:
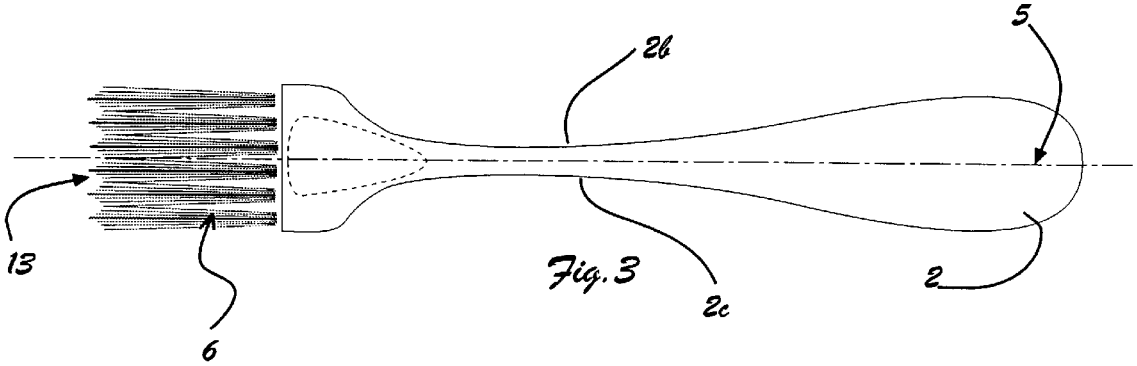
FIG. 3 is a top view of FIG. 2.
Figure 4:
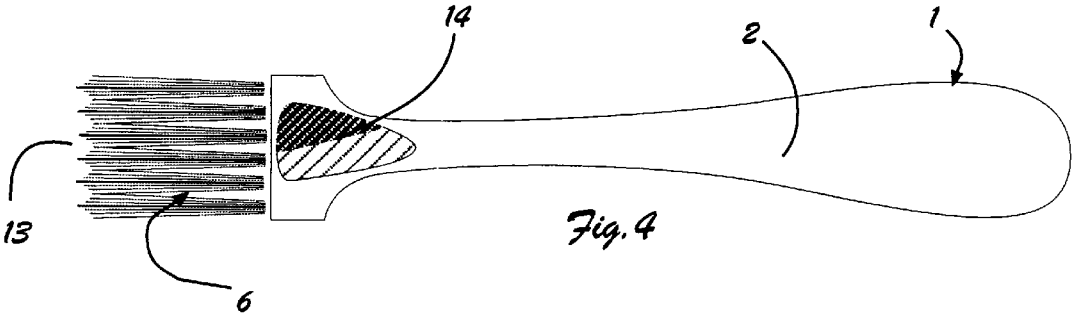
FIG. 4 is a bottom view of FIG. 2.

The flared end 3 has a bristle receiving front face 4 which is disposed substantially transverse to the longitudinal axis 5 of the handle, as better shown in FIG. 3. A plurality of bristles 6 are secured in the front face 4 in a manner well known in the art. As shown, the bristles 6 are oriented in a matrix which coextends with the longitudinal axis 5, that is to say extend in the same direction as this longitudinal axis.

Figure 2:
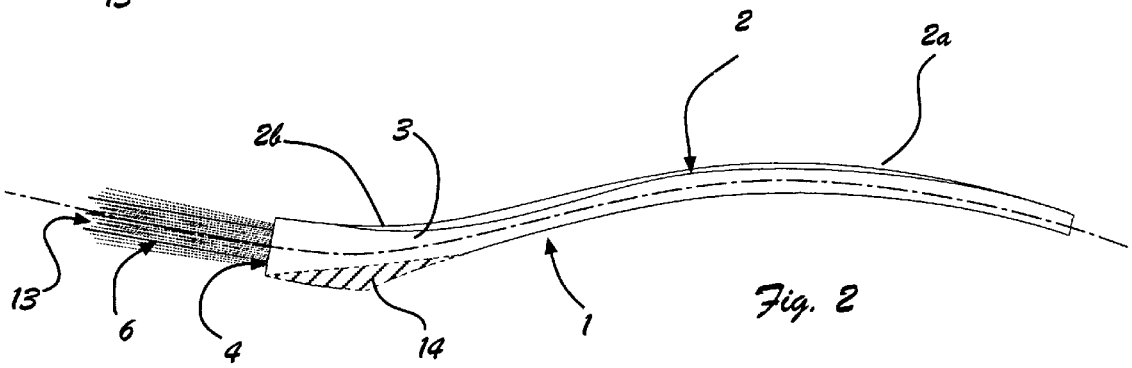
FIG. 2 is a side view of the denture cleaning brush of FIG. 1.
Figure 5:
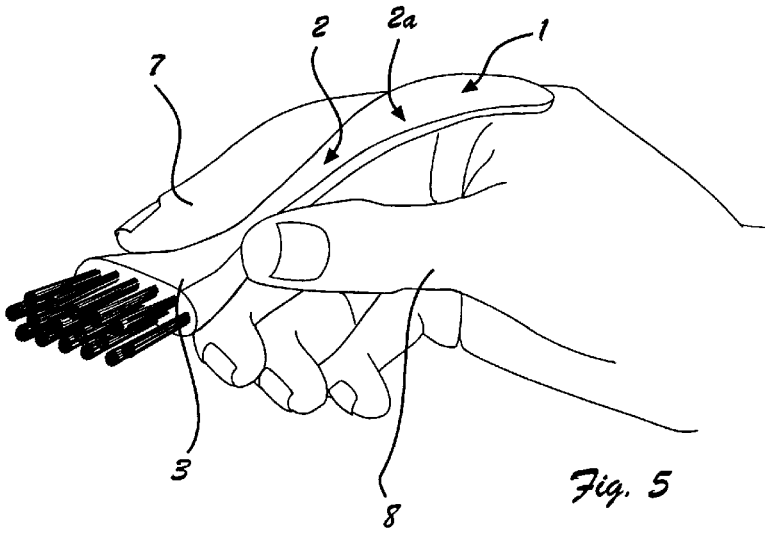
FIG. 5 is a perspective view showing how the denture cleaning brush of the present invention is held between the fmger tips of a user person.

The handle 2, as shown in FIG. 2 extends from the flared end 3 along the longitudinal axis in a plane which is disposed preferably at an angle of 0° to 20° from the plane of the flared end or the longitudinal axis of the bristle matrix. As also shown in FIGS. 1 and 2 the handle is shaped for engagement between finger tips of a user person, similarly, to that of a writing instrument. FIG. 5 shows the brush being held between the index finger 7 and the thumb 8 of a user person. As also shown the handle and the flared end have smoothly curved side edges to provide a comfortable fit between the fingers. The handle when seen from a side thereof, has a long gentle convex shape portion, as designated by reference numeral 2*a*, and extending from a shallow concavature 2*b* on a top wall of the flared end 3. The handle side edges also converge behind the flared end to define a narrow curved finger engaging portion 2*c* and then curve outwardly to define a wider tongue-like shape along the convex portion 2*a*. By holding the brush in the fashion shown in FIG. 5 there is provided an unobstructed visual access to the bristle matrix when cleaning any facet of a denture, as shown in FIGS. 7 and 9.

As also shown in FIGS. 1 to 4, the bristle receiving front face 4 of the brush is a flat face of substantially rectangular contour with the outer end walls being of roundish shape.

Figure 9:
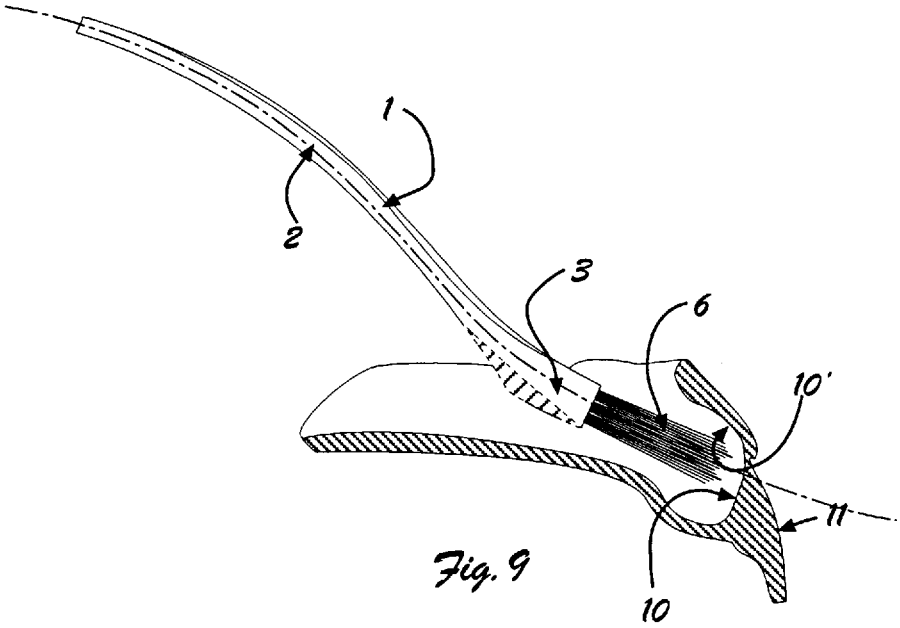
FIG. 9 is a section view of a denture showing how the denture cleaning brush of the present invention has access to cavitated areas of a denture palate.

This bristle receiving front face 4 also has a width which is fairly narrow to permit the insertion of the brush within the denture palate cavities, as better seen in FIGS. 9 whereby to clean hard to reach areas of a denture. Preferably, but not exclusively, the width of the bristle receiving front face is between ¼ in. and ½ in. and the length of the front face is between ½ in. and 1 in.

Figure 6:
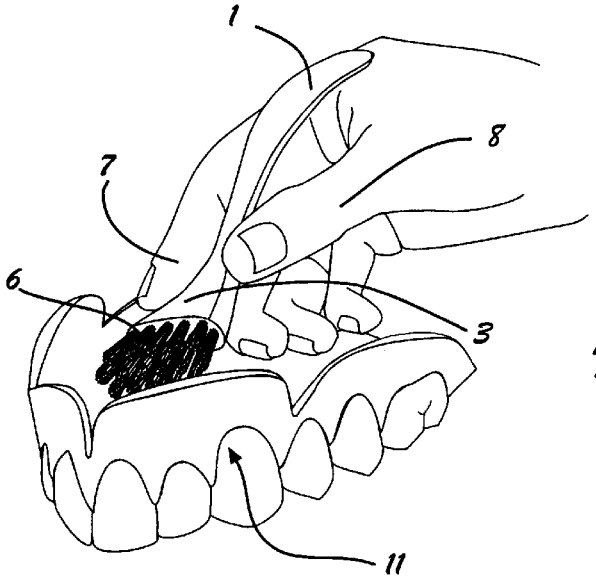
FIG. 6 is another perspective view showing the user person cleaning a denture with the denture cleaning brush of the present invention.
Figure 7:
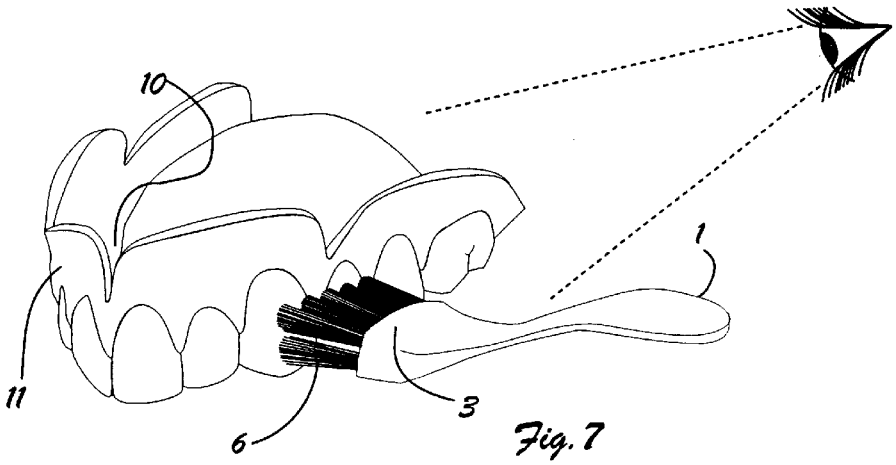
FIG. 7 is a perspective view showing the visual access to a denture being cleaned by the brush.
Figure 8:
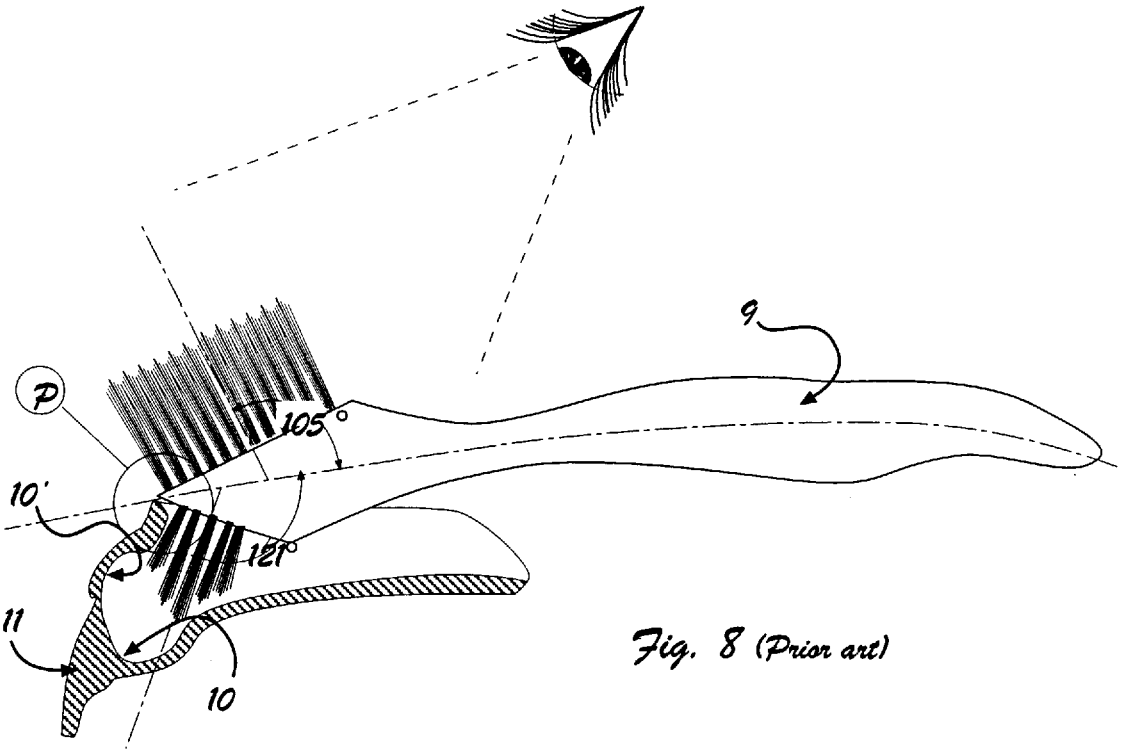
Fig. 8 (Prior art)
FIG. 8 is a section view showing a full scale of a prior art brush and a problem (P) among others inherent in it's design when cleaning dentures.

As shown in FIGS. 6 and 7, with the brush of the present invention, it is quite easy and effortless to clean dentures from the outside of the denture or inside the palate in hard to reach areas as is depicted in FIG. 9. Contrary to this, with prior art brushes with bristles oriented transversally to the brush or at an abrupt angle thereto as shown with the brush 9 in FIG. 8, it is not possible to locate hard to reach areas such as areas 10 and 10', of the inner cavity in a palate of the denture 11 as shown. Experiences also showed that the brush end tip make premature contact with the upper edge of the denture when forcing down the brush to clean deep and hard to reach cavities and undercuts 10 and 10'. To the contrary with the brush 1 of the present invention these cavitated areas 10 and 10' are readily accessible as shown in FIG. 9.

Figure 10A:
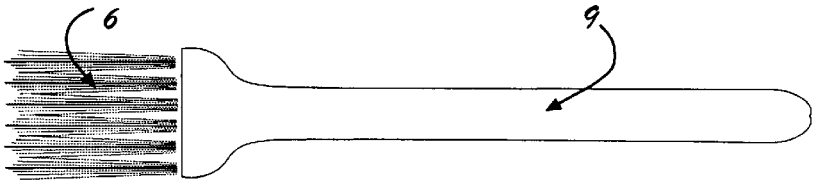
FIGS. 10*a* to 10*c* are planned views showing different designs of the handle of the denture cleaning brush of the present invention.
Figure 10B:
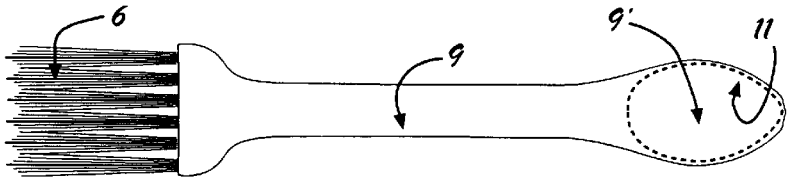
Figure 10C:
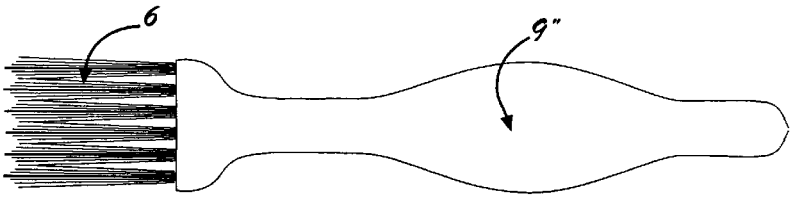

As shown in FIGS. 10*a* and 10*c*, the handle 9 of the toothbrush of the present invention may have various shapes to provide an ergonomic design for comfort holding whereby the brush may be confortable to hold by everyone including people of diminished dexterity. As shown in FIG. 10*a* the handle 9 is a straight handle with the longitudinal axis thereof oriented in the same axis as the bristle matrix 6. The bristle matrix extends straight along the same longitudinal axis as the handle.

The same handle 9 may also be provided with an enlarged rounded free end section 9', as shown in FIG. 10*b*. This end section 9 may also have a cavity 11 therein to constitute a spoon-end whereby to transfer cleaning powder from a bottle for cleaning a denture. FIG. 10*c* shows another handle design wherein an intermediate portion of the handle is enlarged such as shown at 9". This handle may also have a curved shape similarly to that as shown in FIGS. 1 and 2.

Figure 10D:
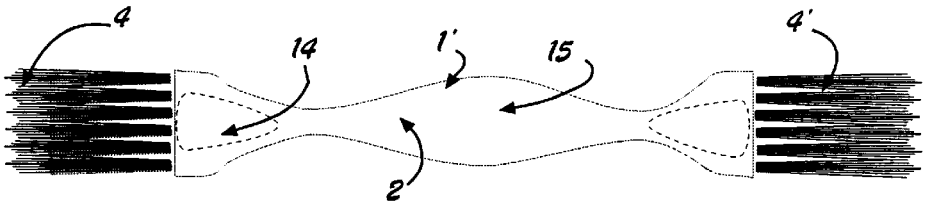
FIGS. 10*d* and 10*e* are side views respectively showing a still further embodiment of the denture cleaning brush of the present invention.
Figure 10E:
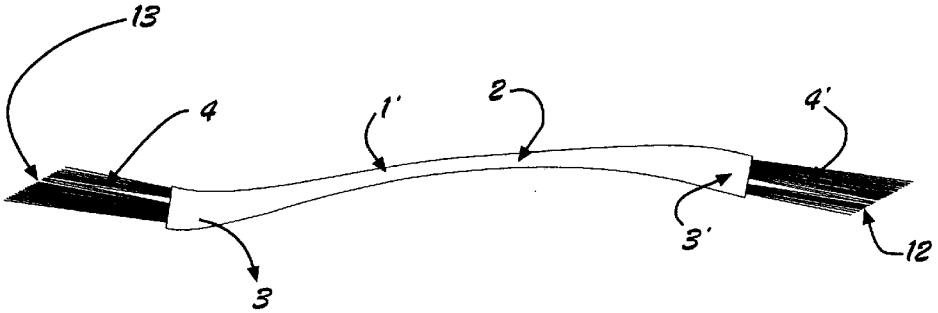

FIG. 10*e* shows another embodiment of the denture cleaning brush 1 of the present invention and herein identified by reference numeral 1'. As herein shown and similar to FIG. 1, the handle has a smoothly curved design, and a flared end 3 and 3' is provide at both ends of the handle. A bristle matrix 4 and 4' is also provided at opposed ends. In this particular embodiment the bristles are also formed with a wedge shaped free-end face 12 whereas, as shown in FIGS. 1 to 4 the end-face is an irregularly end face 12 and 13. The handle as also shown in FIGS. 1 to 4 and 10*d* and 10*e* is provided with a concave finger engaging cavity 14 on the bottom surface thereof and preferably on the enlarged flared end 4. The handle shown in FIG. 10*d* is also provided with a smoothly curved enlarged central portion 15 providing an abutment face which rest smoothly on the hand between the thumb and the index finger. With the embodiments of FIGS. 10*d* and 10*e*, the bristles 4' may be different than the bristles 4 at the other end of the brush and may be provided with rigid bristles for hard scrubbing while the other end may have smoother more flexible bristles to flex and reach cavitated areas. Furthermore, the bristles 4 at one end may be much longer than the bristles 4' at the opposed end whereby to permit the brushing of areas which are disposed in hard to reach cavitated areas of the palate of the denture.

Figure 10F:
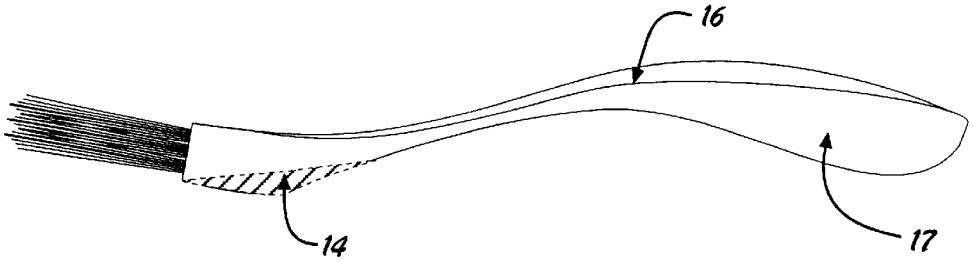
FIG. 10*f* is a side view showing a still further embodiment of the denture cleaning brush of the present invention.

FIG. 10F shows the side view of another handle design wherein the end portion of the handle 16 is enlarged more or less like a tear drop such as shown at 17. This handle may also have a curved shape similarly to that as shown in FIG. 1 and 2.

Although the description above contain specifics, they should not be construed as limiting the scope of the invention, but as merely providing illustrations of some preferred embodiments. Thus, the scope of my invention should be determined by the appended claims and their legal equivalents, rather than only by the examples given.

The embodiments of the invention in which an exclusive property or privilege is claimed are defined as follows:

1. A denture cleaning brush comprising an elongated rigid handle having a flared end portion, said flared end portion having a flat bristle receiving front face of substantially rectangular contour with outer end walls being of roundish shape, said front face being disposed substantially transverse to a longitudinal axis of said handle, a plurality of bristles secured in said front face with said bristles oriented in a matrix coextending with said longitudinal axis, said bristle receiving front face having a narrow width in the range from ¼ inch to ½ inch and a length in the range from ½ inch to 1 inch, said handle being a curved handle which when viewed from the side thereof has a long gentle convex shape portion extending from a shallow concavature disposed on a top wall of said flared end portion, said handle having side edges which converge behind said flared end portion to define a narrow curved finger engaging portion and then said side edges are curved outwardly to define a wider tongue-like shape along said long gentle convex shape portion, said finger engaging portion providing engagement between the finger tips of a person with said long gentle convex shape portion resting on a hand portion of said person whereby to provide unobstructive visual access to said bristle matrix when cleaning any facet of a denture.

2. A denture cleaning brush as claimed in claim 1 wherein said bristle matrix has an irregular shaped free-end face.

3. A denture cleaning brush as claimed in claim 1 wherein said flared end is provided with a concave finger engaging cavity on a bottom surface thereof.

4. A denture cleaning brush as claimed in claim 1 wherein said long gentle convex shape portion of said handle has an enlarged smoothly curved tear drop end.

5. A denture cleaning brush as claimed in claim 1 further wherein there is a bristle matrix at an opposed end of said handle said bristles at each end are of different stiffness and of different lengths, there being short bristles and long bristles.

6. A denture cleaning brush as claimed in claim 5 wherein said short bristles are stiffer than said long bristles.

* * * * *